United States Patent [19]

Puntar et al.

[11] Patent Number: 4,478,279

[45] Date of Patent: Oct. 23, 1984

[54] RETRIEVABLE INSIDE BLOWOUT PREVENTER VALVE APPARATUS

[75] Inventors: Joseph Puntar, Los Angeles; B. J. Parham, Ventura, both of Calif.

[73] Assignee: Hydril Company, Los Angeles, Calif.

[21] Appl. No.: 433,862

[22] Filed: Oct. 12, 1982

[51] Int. Cl.[3] ..... E21B 33/128; E21B 34/06

[52] U.S. Cl. ..... 166/121; 166/133; 166/136; 166/325

[58] Field of Search ..... 166/120, 121, 136, 214, 166/217, 133, 135

[56] References Cited

U.S. PATENT DOCUMENTS

| | | | |
|---|---|---|---|
| 2,139,983 | 12/1938 | Stone | 166/120 |
| 2,144,850 | 1/1939 | Otis | 166/217 |
| 2,640,546 | 6/1953 | Baker | 166/133 |
| 2,644,527 | 7/1953 | Baker | 166/136 |
| 2,859,826 | 11/1958 | Eckel | 166/136 |
| 3,065,794 | 11/1962 | Page | 166/135 |
| 3,670,815 | 6/1972 | Brown | 166/136 |

*Primary Examiner*—Stephen J. Novosad
*Assistant Examiner*—Timothy David Hovis
*Attorney, Agent, or Firm*—Dodge & Bush

[57] ABSTRACT

A retrievable inside blowout preventer valve apparatus for use in blocking undesired upwardly flow in the bore of a rotary drill string during well drilling operations is disclosed. The valve apparatus is installed and retrieved from a subsurface receiver sub connected in the drill string by movement through the bore of the drill string. When shutting off upwardly flow through the bore of the drill string, the valve automatically operably secures and seals itself in the receiver sub. A wireline retrieving tool is used to release the valve apparatus from the receiver sub and to establish a connection therebetween for retrieving the valve apparatus with the wireline.

5 Claims, 3 Drawing Figures

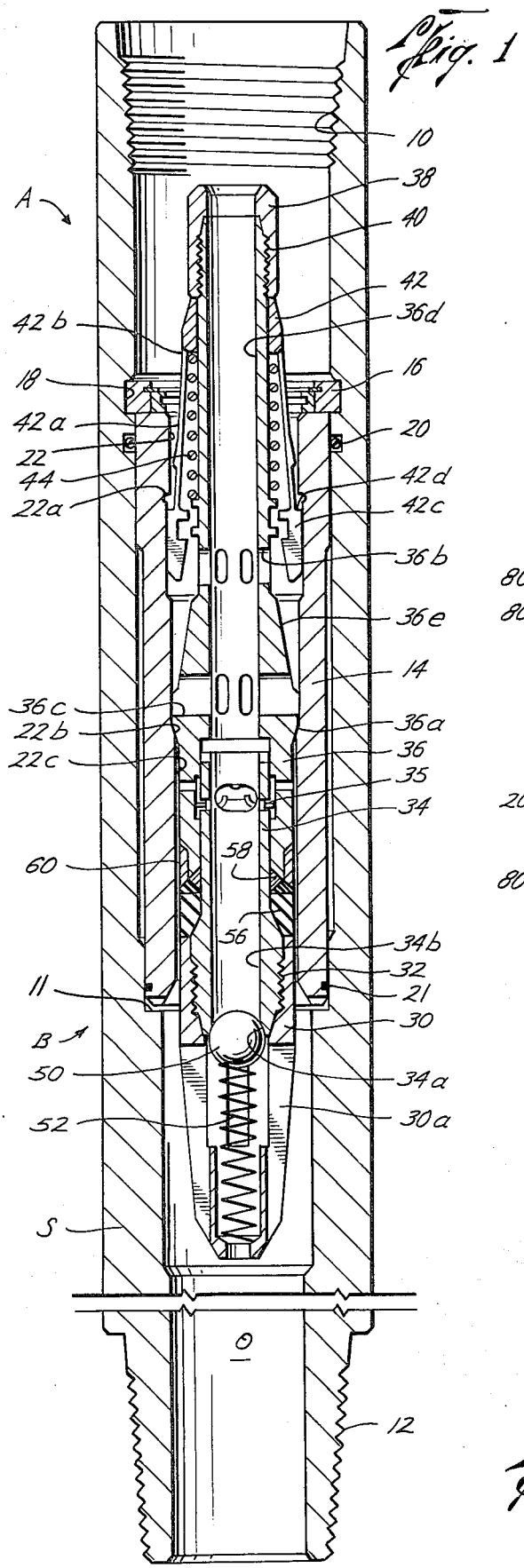
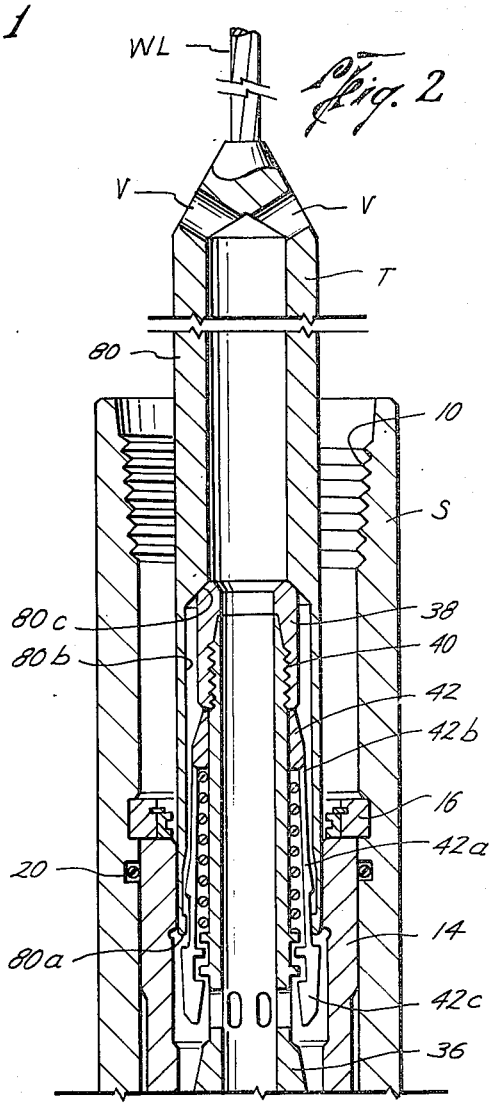
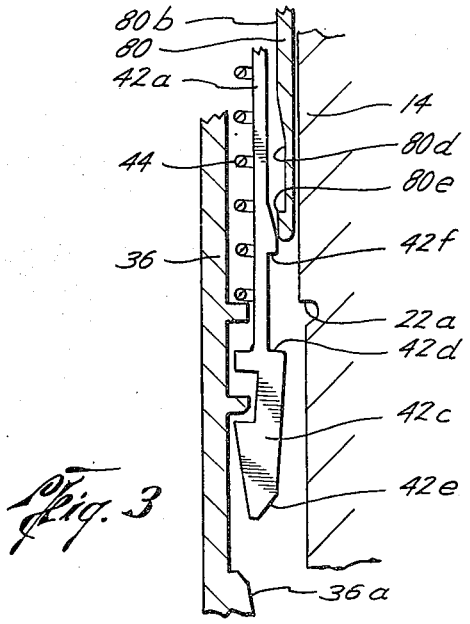
Fig. 3

RETRIEVABLE INSIDE BLOWOUT PREVENTER VALVE APPARATUS

BACKGROUND OF THE INVENTION

The present invention relates generally to the field of a valve apparatus and more particularly to an inside the drill pipe blowout preventer back pressure plug valve apparatus for use in petroleum or geothermal drilling operations that is operably installed and retrieved as desired through the interior flow passage of the drill pipe to control undesired flow therethrough.

DESCRIPTION OF THE PRIOR ART

Inside blowout preventer valve apparatus for use in drill strings at a desired subsurface location to prevent undesired upwardly flow in the bore of the drill string during hydrocarbon well drilling operations have been known and used for some time. U.S. Pat. No. 2,139,983 to Stone, which is assigned to the assignee of the present invention and is completely incorporated herein for all purposes by this specific reference, disclosed a safety back pressure of check valve for operable placement when desired inside a receiver sub connected in the string of drill pipe at a preselected location to provide positive flow control within the pipe. However, once the valve was placed within the flow passage formed in the drill string and moved to and secured in the subsurface receiver sub, it could not be removed from the receiving sub without tripping out the drill string to provide necessary access to the valve apparatus to enable release and removal from the receiver sub. Retrieval of the receiver sub and back pressure plug valve was normally required once the undesired back flow was controlled in order that substantially unrestricted drilling fluid circulation flow down the drill pipe bore could be provided before normal drilling operations could be resumed. Since the receiver sub was usually located immediately above the drill collars for flow control purposes, the entire drill string was normally required to be removed from the well to provide the necessary access for release. The use of the prior blowout preventer valve apparatus has provided the desired safety protection, but required a substantial amount of subsequent lost drilling time when retrieving the valve with attendant substantial increase in drilling cost.

SUMMARY OF THE INVENTION

The present invention relates to a new and improved retrievable inside the drill pipe blowout preventer flow control valve apparatus. The present valve apparatus can be operably installed and retrieved from the subsurface drill string receiver sub mounted at a desired subsurface location in the drill string through the bore of the drill string without tripping out the drill string to release and retrieve the valve apparatus. The retrievable valve assembly includes a valve housing or body having a flow control means for closing a fluid flow passage in the valve housing against upward fluid flow while enabling normal downward flow. The improved valve provides a more sensitive and positive closure against undesired upward well fluid flow at a lower back pressure differential while at the same time providing less of a flow restriction for the normal downward drilling fluid flow. The valve housing carries a radially expansible packing which seals with the receiver sub against undesired upward displacement by the fluid pressure when the valve closes off upward flow. A wireline retrieving tool operates the securing means to release the valve housing and connect with the retrieving tool for upward retrieving movement together within the drill pipe.

BRIEF DESCRIPTION OF THE DRAWINGS

FIG. 1 is a side view, in section, of the retrievable flow control valve apparatus of the present invention releasably secured within the receiver landing sub;

FIG. 2 is a side view, in section, of a portion of the flow control valve apparatus of the present invention with the valve retrieving tool apparatus positioned for effecting release of the flow control valve apparatus from the receiving sub; and FIG. 3 is an enlargement of a portion of FIG. 2 illustrating in greater detail the operation of the valve retrieving tool.

DESCRIPTION OF THE PREFERRED EMBODIMENT

The valve apparatus A of the present invention is illustrated in FIG. 1 operably installed in the bore or central opening O formed in the tubular receiver sub S. The receiver sub S has upper and lower helical threaded ends 10 and 12, respectively, for connecting the receiver sub S in the conventional rotary drill string (not illustrated) at a desired location in the usual manner to form a portion thereof. In accordance with conventional drilling practices, the upper threaded connection 10 is illustrated as a box-type connection while the lower threaded connection 12 is illustrated as a pin connection, it being fully understood that other arrangements or types of end connections may be used with the receiver sub S without departing from the scope of the present invention.

During normal drilling operations, the preferred unrestricted flow or circulation of drilling fluid is down the bore of the drill string and the bore O of the receiver sub S, through the drill bit nozzles (not illustrated) into the well bore and back to the surface in the annulus exteriorly of the drill string and receiver sub S. Should an unexpected pressure pocket or kick be encountered by the drill bit, the fluid pressure effecting desired fluid flow may be reversed and the drilling fluid and other well fluids may commence or tend to commence to flow upwardly through the bore O of the receiver sub S in the drill string. Such undesired upward flow can result in a blowout of the well if not properly controlled by the driller with appropriate means such as by use of the present invention. When such high pressure pockets are either encountered, expected to be encountered, or the driller merely desires the extra safety protection, the valve apparatus A of the present invention may be installed in the bore O of the receiver sub S by movement through the bore of the drill string to the receiver sub S for controlling the undesired upward flow. Typically, the receiver sub S is run in the drill string immediately above the drill collars to minimize loss of hydrostatic head of drilling fluid and will result in the receiver sub S being located at a subsurface location in the well in relatively close proximity to the drill bit itself.

While the receiver sub may be formed of a single tubular member, the illustrated and preferred embodiment includes and utilizes a replaceable sealed landing sleeve 14 that is inserted into the upper end of the sub S adjacent threads 10 until engagement with upwardly facing annular shoulder 11 of the sub S prevents further longitudinal assembly movement. A gapped radially expansible detent ring assembly 16 is received and radially expanded within an annular recess 18 formed in the receiver sub S for releasably securing the landing sleeve 14 within the receiver sub S during operation. The replaceable landing sleeve 14 is sealed to the outer tubular receiver sub S by longitudinally spaced O-rings 20 and 21 which direct the flow of fluid through the bore O of the receiver sub S to pass within a substantially cylindrical inner surface 22 of the landing member 14. The inner surface 22 of the receiver seal and landing sleeve 14 forms a downwardly facing latching annular shoulder **22*a* and an upwardly facing stop annular shoulder 22*b* that are spaced apart a preselected longitudinal distance. The inner surface 22 of the replaceable seal sleeve 14 of the receiver sub S is also provided with a polished or sealing portion 22*c* below the upwardly facing annular shoulder 22*b*. During normal well drilling operations, the receiver sub S including the replaceable sealing sleeve 14** provides a minimum flow resistance or restriction to circulating drilling fluid flow down the bore of the drill string.

The valve apparatus A of the present invention is movable through the bore of the drill string to the receiver sub S for operably securing therein. When installed in the receiver sub S, the valve apparatus A serves to enable desired downward flow of drilling fluid through the inside or bore of the drill string while checking or blocking any undesired upward flow in the bore O of the receiver sub S or the drill string.

The valve apparatus A includes a substantially tubular valve housing or body, generally designated B that is movable through the bore of the drill string to the bore O of the receiver sub S for operable securing therein. The valve body B includes a lower nose or ball keeper portion 30 that is secured by threaded engagement at 32 for assembly with a tubular seat 34. The tubular seat 34 is in turn carried by and mounted with the main valve body portion or sleeve 36 while enabling limited telescopic or longitudinal movement therebetween. The body sleeve 36 forms the downwardly facing outer annular shoulder **36*a* for engagement with the upwardly facing annular stop shoulder 22*b* of the landing sleeve 14 to block further downward movement of and thereby operably position the valve apparatus A in the bore O of the the receiver sub S. The shoulder 22*b*** thus serves as a no-go shoulder precluding further downward movement of the valve apparatus A in the drill string in the conventional manner while enabling passage of other tools to the drill bit.

A tubular retainer cap 38 is fixedly secured concentrically to the main body sleeve 36 by helical threaded engagement at 40. Concentrically slidably mounted on the tubular portion 36 of the valve body B immediately below the retaining ring 38 is a valve securing slip ring 42 having a plurality of downwardly extending securing elements or members **42*a* cantilevered therefrom. Each of the radially flexible securing elements 42*a* has an upper end 42*b* secured to the movable slip ring 42 and an outwardly and downwardly located enlarged second or latching end 42*c*. As best illustrated in FIG. 3, each of the enlarged latching ends 42*c* forms an upwardly facing annular surface valve latching shoulder portion 42*d* for engaging the downwardly facing annular shoulder 22*a* (FIG. 3) when in the radially expanded securing position illustrated in FIG. 1. When the securing element 42*c* is moved radially inward to the released or constricted position of FIG. 3 by flexing of the cantilevered members 42*a*, the valve apparatus A is released and enabled to move from the bore O of the receiver sub S upwardly through the drill string. When moving downwardly in the bore of the drill string to the receiver sub S, the securing elements 42*a* are free to flex inwardly as obstructions in the drill pipe are encountered by tapered surfaces 42*e*** to enable the desired movement to the receiver sub S.

The main tubular body sleeve 36 forms a conical locking surface **36*e* disposed below and normally spaced from the securing elements 42*a*. As will be explained in greater detail hereinafter, the closing off flow through the receiver sub S by the valve apparatus A will result in the tubular body member 36 moving longitudinally upward relative to the expanded securing elements 42*a* for holding the securing elements 42*a* in the radially expanded position with locking surface 36*e* and maintaining the shoulder surface portions 42*d* locked in engagement with the downwardly facing annular shoulder 22*a*. In the absence of such shut-in or contained flow, a biasing spring 44 concentrically disposed on the tubular sleeve 36 below the slip ring 42 will urge the conical locking surface 36*e* and body portion 36 downwardly away from the enlarged securing ends 42*c* of the securing elements 42*a* for enabling their movement to the radial contracted position when desired. This is the usual or typical valve condition which is illustrated in FIG. 1. A plurality of upper pressure equalizing radial ports 36*b* and a similar purpose lower set of radial ports 36*c* are provided in the tubular body member 36** to prevent swabbing of the drill pipe during retrieving movement of the valve apparatus A.

The valve body seat member 34 is secured to the main body portion 36 by a retaining ring and groove arrangement indicated at 35, which enables limited longitudinal movement therebetween while providing a suitable connection therebetween. The lower end of the tubular seat 34 is provided with a downwardly facing conical sealing surface **34*a* which sealingly engages with a ball closure member 50 in the conventional manner for blocking upwardly flow of fluid through a central flow opening 34*b* of the seat member 34 in the usual manner. A biasing spring 52 carried by the nose member 30 forces or urges the ball flow closure element 50 upwardly into sealing engagement with the seat 34 in the absence of downwardly fluid flow in the usual manner. Longitudinally extending rib portions 30*a* of the nose member 30 enable flow of fluid about the ball 50 when spaced from the seat 34 in the usual manner while providing mounting support for the spring 52. The tubular seat 34 is concentrically aligned with the tubular body member 36 for aligning the central openings 34*b* and 36*d*, respectively, to provide a substantially straight through fluid flow passage through the valve body B. As noted previously, contained upwardly fluid flow will move the ball 50 and seat 34 upwardly to engage the main body sleeve 36. Such upward movement will continue with the main body sleeve 36 by compressing spring 44 until stopped or abated by engagement of the locking surface 36*e* with the securing elements 42*c***.

The valve body B carries a sealing means on its exterior surface immediately above the threads engagement at 32 and below the main body portion 36. The resiliently deformable sealing or packing element 56 forms a flow blocking seal between the landing sleeve 14 of the receiver sub S and the body B of the valve apparatus A to preclude passage of fluid therebetween and to direct the flow through the fluid flow passages **34*b* and 36*d*** formed through the valve body sleeves 34 and 36, respectively.

To prevent extrusion of the resilient packing or sealing element 56 as the closed in upward fluid pressure urging on the ball seat 34 and ball 50 increases split anti-extrusion rings 58 and 60 are also activated by the longitudinal movement of the seat 34 to the main body sleeve 36 for further enhancing the sealing pressure. The inner anti-extrusion ring 58 closes on the ball seat 34 above the sealing element 56 while the upper or outer split ring 60 prevents extrusion of the sealing element 56 between the tubular body member 36 and the receiving sleeve 14 of the receiver sub S. Both the composition of the packing elements 56 and its internal reinforcement may be selected to prevent both undesired leakage or extrusion.

A retrieving tool T for releasing and connecting with the valve apparatus A for returning together upwardly through the bore of the drill pipe is illustrated in FIG. 2. The retrieving tool T is connected to sinker bars (not shown) and is suspended by a wireline WL in the conventional manner and is provided with vent openings V to prevent swabbing of the bore of the drill pipe as is well known in the art. The retrieving tool T is generally of the type known as an overshot with a substantially tubular body having an open lower end forming a downwardly facing annular shoulder 80*a*. A substantially cylindrical inner surface 80*b* extends upwardly a preselected distance from the shoulder 80*a* where it commences to form a downwardly facing locating and centering annular shoulder 80*c*. As previously described herein, the upwardly facing annular shoulder 22*b* engages the downwardly facing annular shoulder 36*a* formed on the main body portion 36 of the valve apparatus A to prevent further downward movement in the receiver sub S. Accordingly, engagement of the downwardly facing annular shoulder 80*a* with the valve apparatus A will normally be with the securing elements 42*a* and will force or flex the securing members 42*a* inwardly as illustrated in FIG. 3. This will move the upwardly facing shoulder portions 42*d* from engagement with the downwardly facing annular shoulder 22*a* for releasing the valve apparatus A from the sub S. Continued downward movement of the retrieving tool T will not only hold or maintain the securing elements 42*b* in the radially contracted position by engagement with the inner surface 80*b*, but will also place an annular recess 80*d* having an upwardly facing annular shoulder 80*e* below a downwardly facing annular surface portion 42*f* formed on each of the securing elements 42*a*. The engagement of the shoulders 80*e* and 42*f* will connect the valve apparatus A with the retrieving tool T to enable movement back to the surface by reeling in the wireline WL in the usual manner. During such upward movement, the inner surface 80*b* will maintain the securing elements 42*a* in the radially contracted position to enable their movement through any obstruction in the drill pipe while the retainer ring 38 will prevent their separation from the valve apparatus A while assuring proper spacing from the conical locking surfaces 36*e*.

Should the valve apparatus A be containing an upwardly flow pressure, the resulting upward movement of the body sleeve 36 will engage the locking surface 36*e* with the securing element ends 42*c* as previously explained and positions the retainer 38 for engaging the shoulder 80*c* of the retrieving tool T. This arrangement prevents full engagement and release of the securing elements 42*a* of valve apparatus A by the retrieving tool T when holding well pressure.

USE AND OPERATION OF THE PRESENT INVENTION

In the use and operation of the present invention, the receiving sub S is assembled in the manner indicated with the replaceable landing nipple 14 operably secured therein by radially expanding detent apparatus 16. The valve apparatus A is also assembled in the manner illustrated. The receiving sub S is made up in the drill string in the conventional manner and forms a portion of the rotary string during drilling operations.

When the driller desires to control undesired fluid flow conditions, the valve apparatus A is placed in the bore of the drill string at the surface and enabled to move to the receiver sub S either by the force of gravity or more typically pumped down the drill string by the use of the drilling fluid circulation pumps. During such downward movement, the tapered surfaces 42*e* of the securing elements 42*a* will wedge the securing elements to flex inwardly to enable passage by any restrictions encountered in the drill pipe.

When the downwardly facing shoulder 36*a* of the valve apparatus A encounters the upwardly facing stop shoulder 22*b* of the replaceable landing member 14, the securing elements 42*a* are properly positioned to expand radially outwardly under the downwardly facing latching shoulders 22*a*.

As previously explained, seating of the ball 50 coupled with undesired reversal of drilling fluid circulation will initially move the seat member 34 upward relative to the main body sleeve 36 to radially expand the sealing member 56 for sealing with the landing member 14. Continued movement will result in the ball 50, the seat 34, and the main body portion 36 moving upwardly by compressing spring 44 until the conical locking surface 36*e* engages the securing element ends 42*c* for locking or maintaining them in engagement with the downwardly facing annular shoulder 22*a*.

Once the upward fluid flow is contained, control over the well drilling operations may be achieved by suitable means. Normally this entails reestablishment of downward circulation through the bore of the drill pipe which flow condition will return the valve apparatus A to the extended condition illustrated in FIG. 1. Once the extended valve apparatus A condition is achieved, the retrieving tool T may be lowered down the bore of the drill string for engaging the flexible securing elements 42*a* and effecting release by their radial movement in the manner previously explained. When separated from the downwardly facing annular shoulder 22*a* and properly connected with the retrieving tool T by engagement of the shoulders 42*f* and 80*e*, the valve apparatus may be retrieved back to the surface with the wireline WL of the retrieving tool T in the usual manner.

Upon reaching the surface, disengagement of the retrieving tool T from valve apparatus A is accomplished by hand utilizing sufficient thumb and finger pressure applied inwardly to the securing element ends 42*c* of valve apparatus A to cause separation of shoulders 80*e* and 42*f* and contraction of securing elements 42*a* out of annular recess 80*d* of the retrieving tool T while pulling the valve apparatus A downwardly away from the retrieving tool T.

The foregoing disclosure and description of the invention are illustrative and explanatory thereof, and various changes in the size, shape and materials, as well as in the details of the illustrated construction, may be made without departing from the spirit of the invention.

We claim:

1. A retrievable inside blowout preventer valve apparatus adapted to be operably installed in a bore of a tubular receiver sub mounted in a drill string for providing a positive closure against upward fluid flow in the bore of the receiver sub while enabling passage of the normal downward flow of drilling fluid in the bore of the drill string, including:

a valve body movable through the bore of a drill string to and from the bore of the receiver sub mounted in the drill string, said valve body having a fluid flow passage formed therethrough for communicating the bore of the receiver sub above and below said valve body;

means mounted with said valve body for closing said fluid flow passage upon upward fluid flow in the bore of the drill pipe and for enabling a downward flow through said fluid flow passage and the bore of the drill pipe;

means carried by said valve body for sealing said valve body with the receiver sub for blocking leakage of well fluid therebetween to direct the flow of fluid through the bore of the receive sub through said fluid passage;

means mounted with said valve body for releasably securing said valve body with the receiver sub to hold said valve body against undesired upward movement during flow control operation of said valve assembly, said means for securing releasable to enable upward retrieving movement of said valve body from the receiver sub through the bore of the drill pipe when desired;

said means for releasably securing including a plurality of securing elements movably disposed in said valve body for radial movement to and from an expanded securing position for engaging a downwardly facing annular shoulder formed in the bore of the receiver sub to block upwardly movement of said valve body from the receiver sub and a contracted released position to enable desired movement of said valve body through the bore of the drill string;

said valve body having a conical locking surface, said plurality of securing elements operably engaging said conical locking surface for maintaining said plurality of securing elements in the radially expanded securing position, said securing elements capable of being movable radially inwardly to the contracted released position when said conical locking surface moves relative to said securing elements;

a slip ring movably disposed on said valve body, each of said securing elements having a first end a second end, each of said securing elements connected at said first end to said slip ring to enable the radial movement of each of said second ends to and from the expanded securing position and the contracted release position; and spring means mounted with said valve body for urging said slip ring to position said securing elements relative to said conical locking surface to enable radial inward movement of said securing elements to the contracted released position.

2. The valve apparatus as set forth in claim 1, wherein:

said valve body is movable relative to said slip ring in response to the closed in fluid pressure in said fluid flow passage to position said conical locking surface for maintaining said plurality of securing elements in the expanded securing position.

3. The valve apparatus as set forth in claim 2, wherein:

said means for releasably securing actuated by operable connection with a retrieving tool to release said valve body from the receiver sub to enable retrieval through the bore of the drill string from the receiver sub.

4. The valve apparatus as set forth in claim 2, including:

a retrieving tool movable through the bore of the drill string to said valve body operably secured in the bore of the receiver sub, said retrieving tool having a tubular portion for operating said plurality of securing elements to the constricted released position for releasing said valve body from the receiver sub and for connecting said released plurality of securing elements with the retrieving tool for movement together through the bore of the drill pipe from the receiver sub.

5. The valve apparatus as set forth in claim 4, wherein:

each of said securing elements forming a downwardly facing annular shoulder;

said tubular portion of said retrieving tool forming an inner surface having an upwardly facing portion, said inner surface moving said plurality of securing elements to the constricted released position, said upwardly facing portion engageable with said downwardly facing shoulder formed of said securing elements to operably connect said valve body with said retrieving tool for movement through the bore of the drill string while said inner surface holds said plurality of securing elements in the constricted position during such movement.

* * * * *